US005331890A

United States Patent [19]

Miyoshi et al.

[11] Patent Number: 5,331,890

[45] Date of Patent: Jul. 26, 1994

[54] MULTICOLOR PRINTING PRESS

[75] Inventors: Masahiko Miyoshi, Ayase; Kiyohisa Asanuma, Kawasaki; Kazuhiro Soutome, Zama, all of Japan

[73] Assignee: Kabushiki Kaisha Tokyo Kikai Seisakusho, Tokyo, Japan

[21] Appl. No.: 74,712

[22] Filed: Jun. 9, 1993

Related U.S. Application Data

[63] Continuation of Ser. No. 889,788, May 28, 1992, abandoned.

[30] Foreign Application Priority Data

Nov. 14, 1991 [JP] Japan ..... 3-353537

[51] Int. Cl.[5] ..... B41F 5/08; B41F 13/14

[52] U.S. Cl. ..... 101/177; 101/180; 101/248

[58] Field of Search ..... 101/220, 177, 248, 181, 101/182, 137, 138, 139, 136, 140, 142, 143, 180, 179

[56] References Cited

U.S. PATENT DOCUMENTS 4,207,815 6/1980 Watanabe ..... 101/248
4,534,288 8/1985 Brovman ..... 101/181
4,651,641 3/1987 Kawata et al. ..... 101/217
4,831,926 5/1989 Bowman et al. ..... 101/181
5,152,222 10/1992 Okamura et al. ..... 101/211

FOREIGN PATENT DOCUMENTS 3-1946 1/1991 Japan .

*Primary Examiner*—J. Reed Fisher
*Attorney, Agent, or Firm*—Trexler, Bushnell, Giangiorgi & Blackstone, Ltd.

[57] ABSTRACT

In a multicolor printing press which has a plurality of printing sections arranged in vertical alignment, the multicolor printing press facilitates adjustment of register position between a plurality of printing sections. The multicolor printing press thus has a first printing section which includes at least one first plate cylinder, and at least one second printing section which includes at least one second plate cylinder. The multicolor printing press is also provided with means for rotatably supporting the first plate cylinder in a fixed register position for providing reference position in adjustment of register position in the second printing section, means for rotatably supporting the second plate cylinder, and adjusting means of register position of said second plate cylinder relative to the reference position defined by the first plate cylinder.

9 Claims, 12 Drawing Sheets

MULTICOLOR PRINTING PRESS

This application is a continuation of application Ser. No. 07/889,788, filed May 28, 1992, now abandoned.

BACKGROUND OF THE INVENTION

1. Field of the Invention

The present invention relates generally to a multicolor printing press, in which a plurality of printing sections are vertically arranged in spaced apart relationship for establishing a multi-stage printing press. Further particularly, the invention relates to a multicolor printing press with enhanced registering between respective stages of individual color printing.

2. Description of the Related Art

Japanese Unexamined Patent Publication (Kokai) No. 3-1946 discloses a construction of a multicolor printing press, in which a plurality of printing devices are vertically arranged in spaced apart relationship. The above-identified publication also discloses a register position adjusting means which minimizes register error of printing patterns between the printing sections. The printing register position adjusting means in the shown construction comprises at least means for adjusting along an axial direction of each plate cylinder relative to a corresponding blanket cylinder, for each of the printing sections.

However, in the prior art, a reference color for adjustment of register position is not fixed in multicolor printing. Therefore, it is possible that the reference color is differentiated for every cycle of printing operation to require adjustment of the register position every time the reference color is differentiated. For example, it can be experienced that, during adjustment of register position of respective plate cylinders in respective printing section in order with taking a certain color as the reference color, the adjustment of register position cannot be completed even at the allowable limit of adjustment for one of the colors to require modification of the original plan. Typically, in such case, the color for which adjustment of register position fails, is taken as the reference color to perform register position adjustment again. Such procedure clearly degrades efficiency of printing operation and increases lost paper due to printing with faulty registering.

SUMMARY OF THE INVENTION

It is therefore an object of the present invention to provide a multicolor printing press which can provide improvement in adjustment of register position between a plurality of printing sections.

Another object of the present invention is to provide a multicolor printing press which allows adjustment of register position with a predetermined fixed reference for adjustment.

In order to accomplish aforementioned and other objects, a multicolor printing press of the present invention comprises the below-described constructions.

A plurality of printing sections are arranged in vertical alignment, and a plurality of the printing sections include a first printing section which includes at least one first plate cylinder, at least one second printing section which includes at least one second plate cylinder, means for rotatably supporting the first plate cylinder in a fixed register position for providing reference position in adjustment of register position for printing in the second plate cylinder of the second printing section, means for rotatably supporting the second plate cylinder, and adjusting means of register position of said second plate cylinder relative to the reference position defined by the first plate cylinder.

In the construction set forth above, the multicolor printing press may further comprises a first printing assembly and a second printing assembly. Said first printing assembly comprises said first plate cylinder with a first ink arrangement and a first blanket cylinder being disposed adjacent to said first plate cylinder. Said second printing assembly comprises said second plate cylinder with a second ink arrangement and a second blanket cylinder being disposed adjacent to said second plate cylinder. A pair of said first and second blanket cylinders are provided so as to move in contact with each other and in separation from each other. Said first and second plate cylinders may further provide with first and second damping arrangements respectively. Either one of said pair of printing assemblies may be an impression cylinder.

In practice, preferably, the first printing section is located at most upstream position relative to feed direction of a web paper to be printed so that the first printing section performs printing for a printing pattern serving as reference printing pattern in advance of the second printing section.

It is possible that the outer peripheral portion of the second plate cylinder is divided in axial direction to form a first plate cylinder component and a second plate cylinder component arranged in axial alignment with respect to each other, and said adjusting means are provided independently of the first and second plate cylinder components.

In the practical construction, said adjusting means may include a first register position adjusting means for adjusting register position of the second plate cylinder relative to the reference position of the first plate cylinder in an axial direction along a rotation axis thereof. The adjusting means may also includes a second register position adjusting means for adjusting register position of the second plate cylinder relative to the reference position of the first plate cylinder in a circumferential direction.

Depending upon application, the ink arrangement and said damping arrangement can be arranged beneath the corresponding plate cylinder.

BRIEF DESCRIPTION OF THE DRAWINGS

The present invention will be understood more fully from the detailed description given herebelow and from the accompanying drawings of the preferred embodiment, which, however, should not be taken to limitative to the invention, but are for explanation and understanding only.

In the drawings.

DESCRIPTION OF THE PREFERRED EMBODIMENTS

Figure 1:
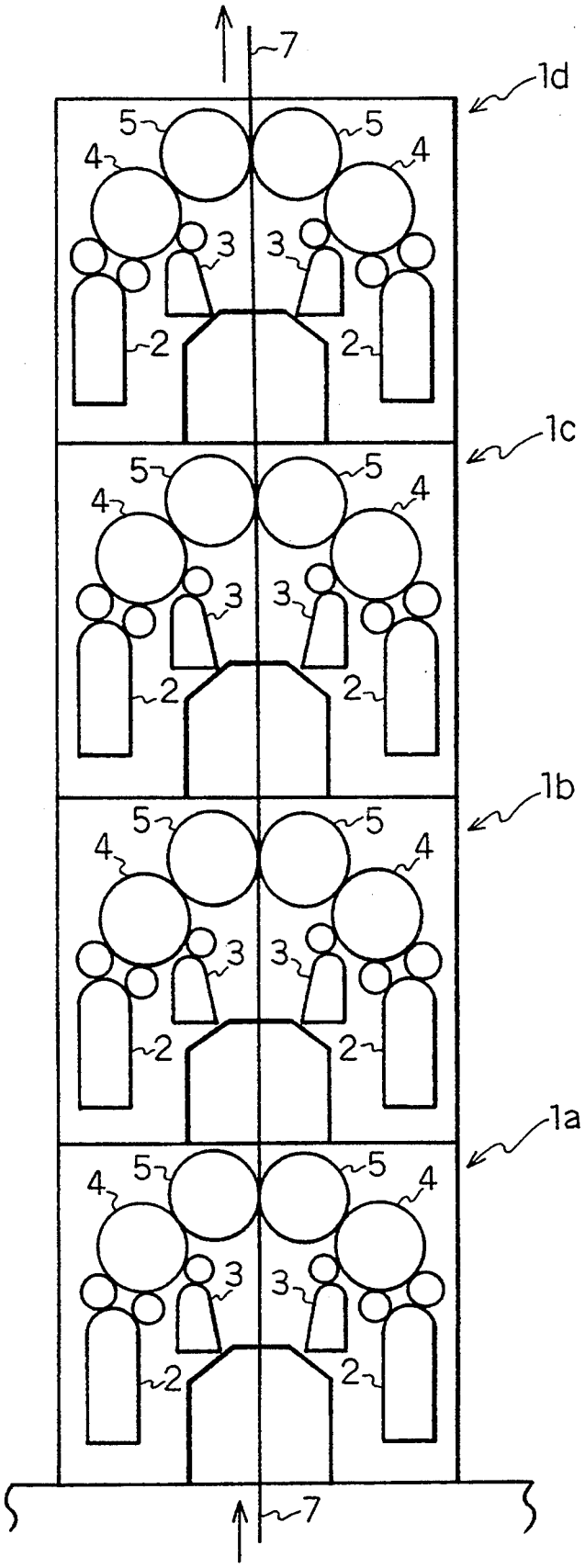
FIG. 1 is a diagrammatic illustration showing the first embodiment of a multicolor printing press according to the present invention.
Figure 2:
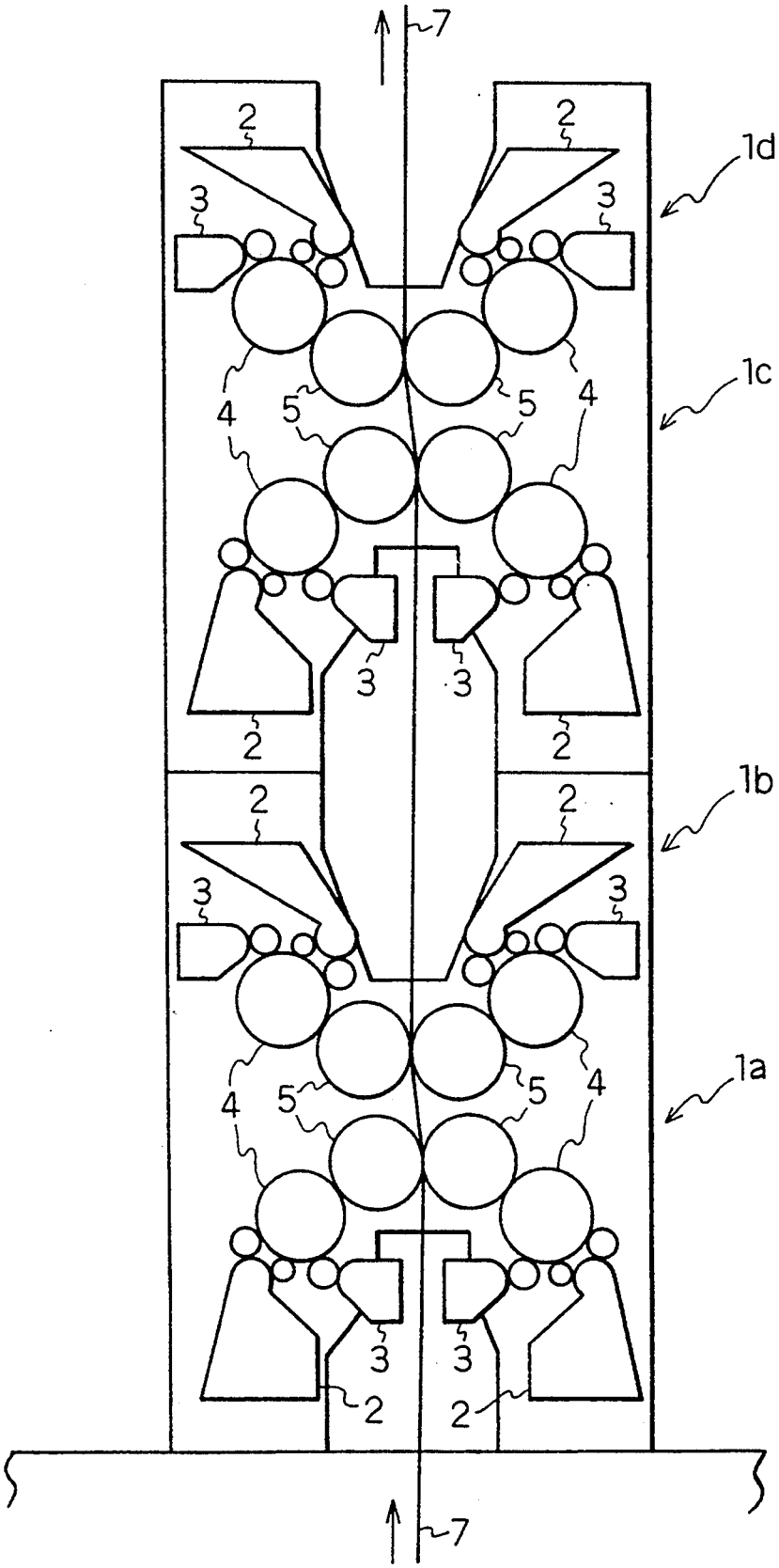
FIG. 2 is a diagrammatic illustration showing the second embodiment of a multicolor printing press according to the invention.
Figure 3:
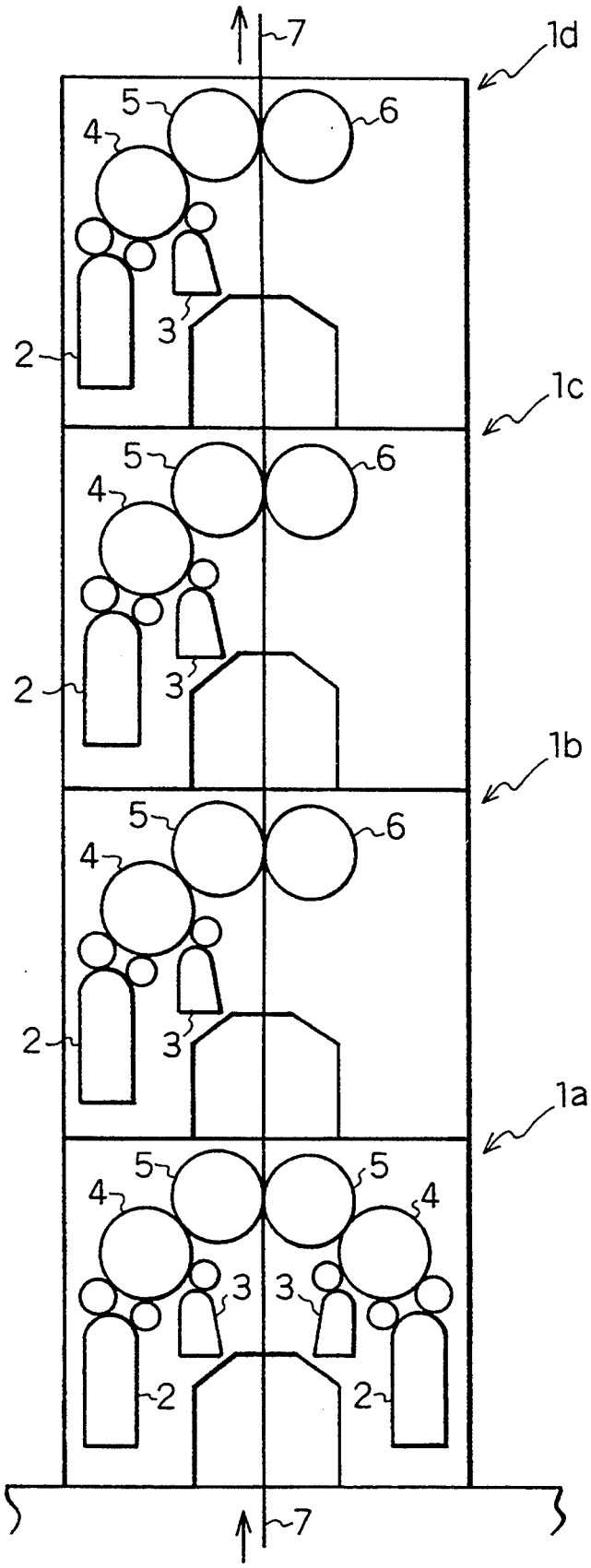
FIG. 3 is a diagrammatic illustration showing the third embodiment of a multicolor printing press according to the invention.

Referring now to the drawings, particularly to FIGS. 1 to 3, there are briefly and diagrammatically illustrated first, second and third embodiments of a multicolor printing press according to the present invention. The multicolor printing press comprises a plurality of printing sections arranged in vertical alignment for multistage printing for respective of colors. Typically, the multicolor printing press comprises four stages of vertically arranged printing sections 1*a*, 1*b*, 1*c* and 1*d* respectively for printing three primary colors, i.e. cyan, magenta and yellow, and black. The printing section or printing sections as generally referred to will be represented by the reference numeral 1. A web paper 7 is initially supplied to the lowermost printing section 1*a* and runs upwardly through the second, third and fourth printing sections 1*b*, 1*c* and 1*d* for printing respective different color patterns.

It should be noted that although the fourstage multicolor printing press is typical, number of printing sections to be employed for forming the multicolor printing press is not essential to the present invention and thus can be varied depending upon applications.

First and second embodiments of FIGS. 1 and 2 are designed for printing color patterns on both sides of the web paper 7. Each printing section 1 includes pair of plate cylinders 4, 4 associated with ink arrangements 2, 2 and damping arrangements 3, 3. Opposing to respective of the plate cylinders 4, 4 a pair of blanket cylinders 5, 5 are provided in juxtaposition therewith. The blanket cylinders 5, 5 oppose in close proximity with each other across a path of the web paper 7 and are movable toward and aft from each other. Therefore, the blanket cylinders 5, 5 are in contact with both sides of the web paper 7 for transferring color printing pattern transferred from a printing plate (not shown) on the plate cylinders 4, 4 onto mating surfaces of the web paper 7.

On the other hand, the third embodiment of the multicolor printing press of FIG. 3 has the lowermost, first printing section 1*a* which is designed for both sides printing similarly to the foregoing first and second embodiments, and the second, third and fourth printing sections 1*b*, 1*c* and 1*d* which are designed for single side printing for printing color patterns only one side of the web paper 7. Therefore, each of the second, third and fourth printing sections 1*b*, 1*c* and 1*d* is provided one set of the plate cylinder 4 and the blanket cylinder 5. An impression cylinder 6 is provided in the close proximity of the blanket cylinder 5 and oppose thereto across the path of the web paper 7. The ink arrangement 2 and the damping arrangement 3 are provided substantially the same manner to the foregoing first embodiment.

As can be seen from FIGS. 1 and 3, the ink arrangements 2, 2 and the damping arrangements 3, 3 in the first and third embodiments for the plate cylinders 4, 4 in respective printing sections 1 are designed to supply ink and water toward the upper direction against gravity from the lower sides of respectively associated plate cylinders.

On the other hand, in the second embodiment of FIG. 2, though the ink arrangements 2 and the damping arrangement 3 in the first and third printing sections 1*a* and 1*c* are arranged in the same manner to the first and third embodiment for supplying the ink and the water from the lower sides of respectively associated plate cylinders 4, the ink arrangements 2 and the damping arrangements 3 of the second and fourth printing sections 1*b* and 1*d* are located at the upper side of respectively associated plate cylinders 4 so that they may supply the ink and the water from the above to the lower direction.

As can be appreciated, the present invention is applicable for various constrictions of multicolor printing presses with variety of layouts of the components, such as the plate cylinder, blanket cylinder, the impression cylinder, the ink arrangement and the damping arrangement. Therefore, the arrangements illustrated in FIGS. 1 to 3 are to be regarded as mere examples of the multicolor printing presses, for which the present invention is applicable.

In the present invention, the plate cylinders 4, 4 in one of a plurality of the printing sections 1*a*, 1*b*, 1*c* and 1*d* serve as fixed reference for adjustment of registering for the plate cylinders 4, 4 in remaining printing sections. In practice, it is preferred that the plate cylinders 4, 4 in the lowermost, first printing section 1*a* are taken as reference for adjustment of registering positions of respective of plate cylinders 4, 4 in the remaining printing sections 1*b*, 1*c* and 1*d*.

Figure 4:
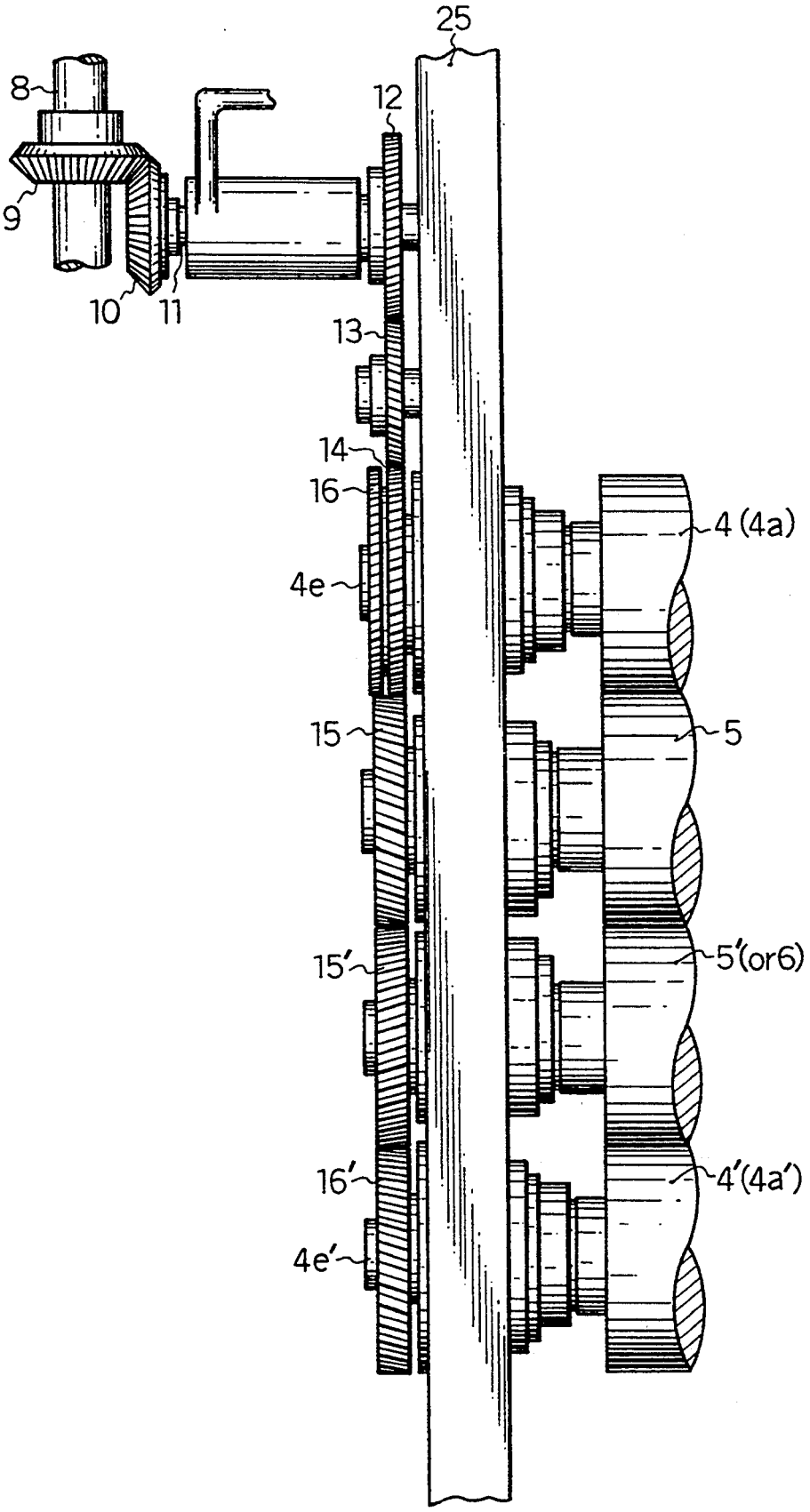
FIG. 4 is a partial plan view showing arrangement of plate cylinders or divided plate cylinders and blanket cylinders (or impression cylinder) at a drive side in the lowermost printing section in the first to third embodiments of FIGS. 1 to 3.
Figure 5:
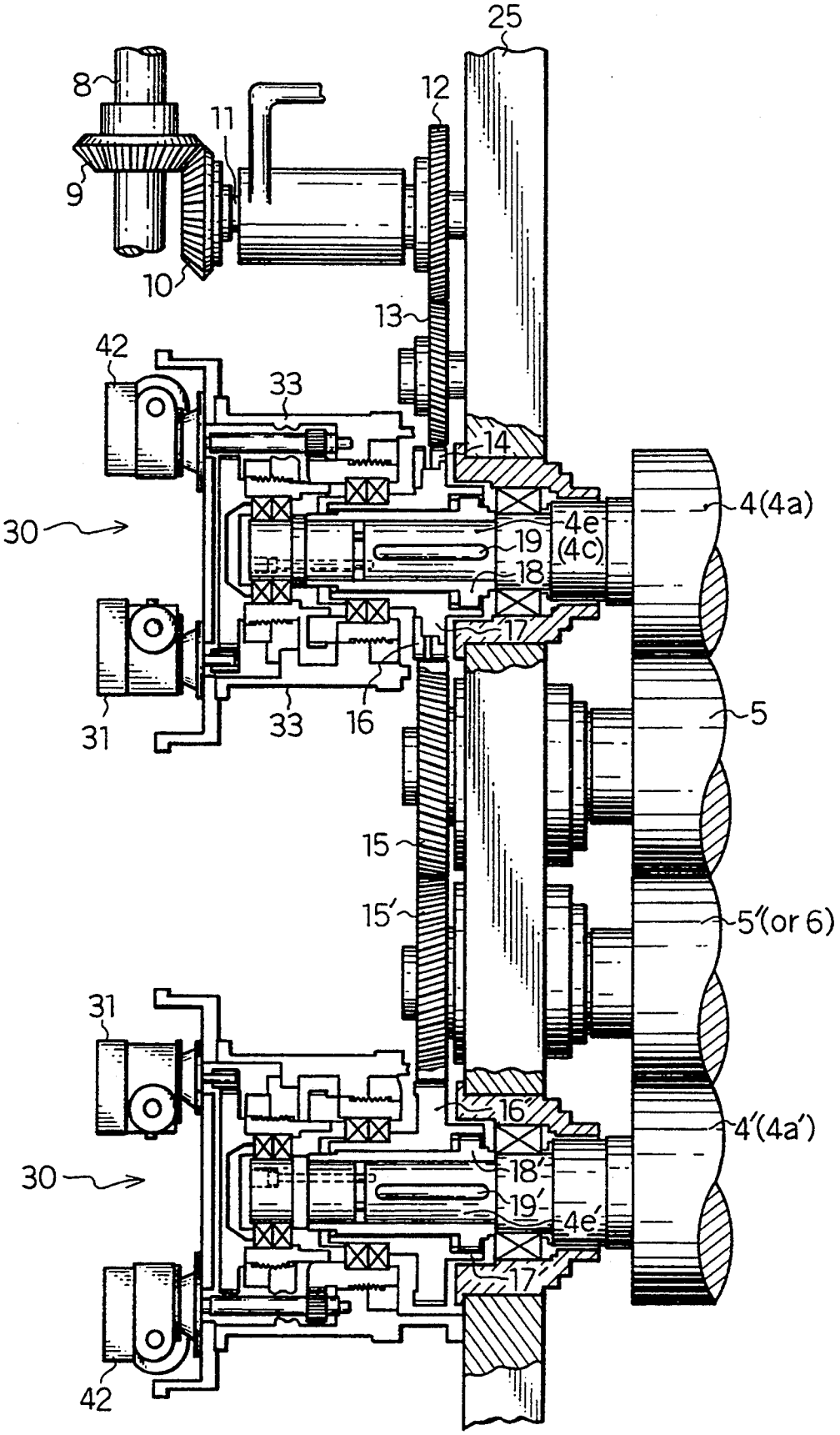
FIG. 5 is a partial sectional plan view showing arrangement of plate cylinders or divided plate cylinders and blanket cylinders (or impression cylinder) at a drive side in each of the printing sections. But, in the printing sections other than the lowermost printing section in the third embodiments of FIG. 3, wherein, in case of the shown construction as applied to the third embodiment is to be understood that the plate cylinder or the divided plate cylinder of the lowermost portion in FIG. 4 is to be removed.
Figure 6:
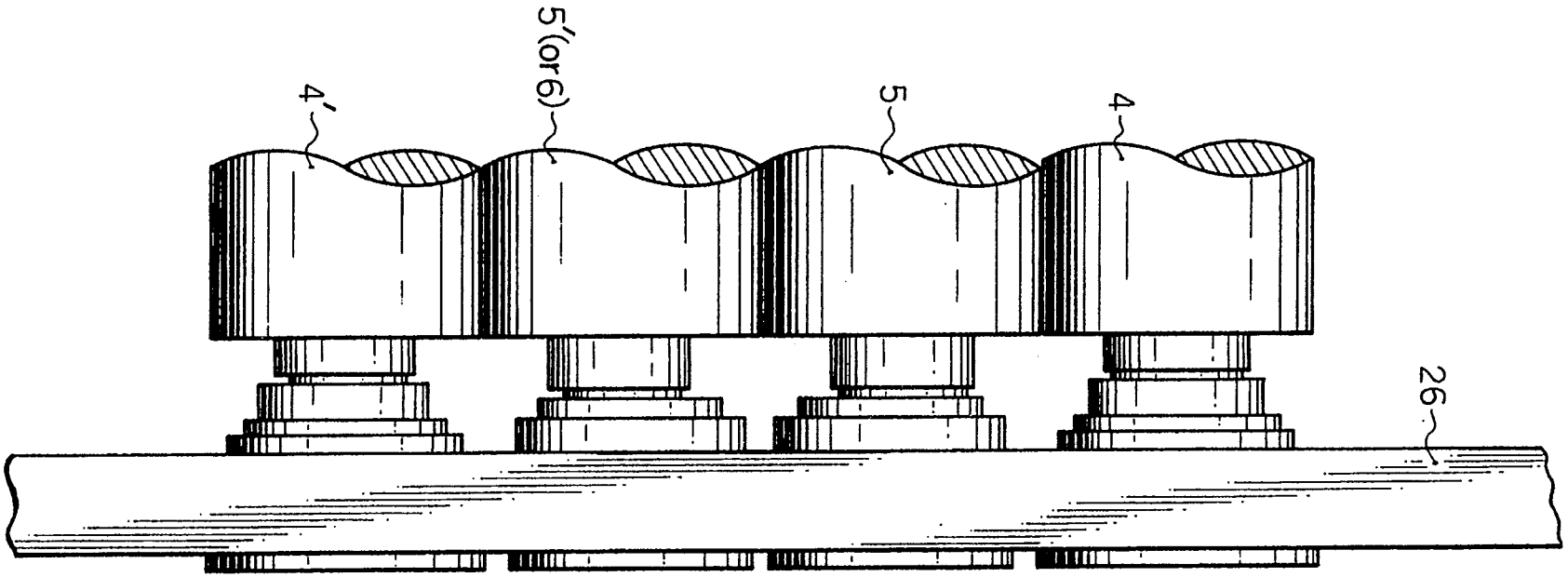
FIG. 6 is a partial plan view showing arrangement of the plate cylinders and blanket cylinders (or the impression cylinder) at an operation side in the lowermost printing section in the first to third embodiments of FIGS. 1 to 3.
Figure 7:
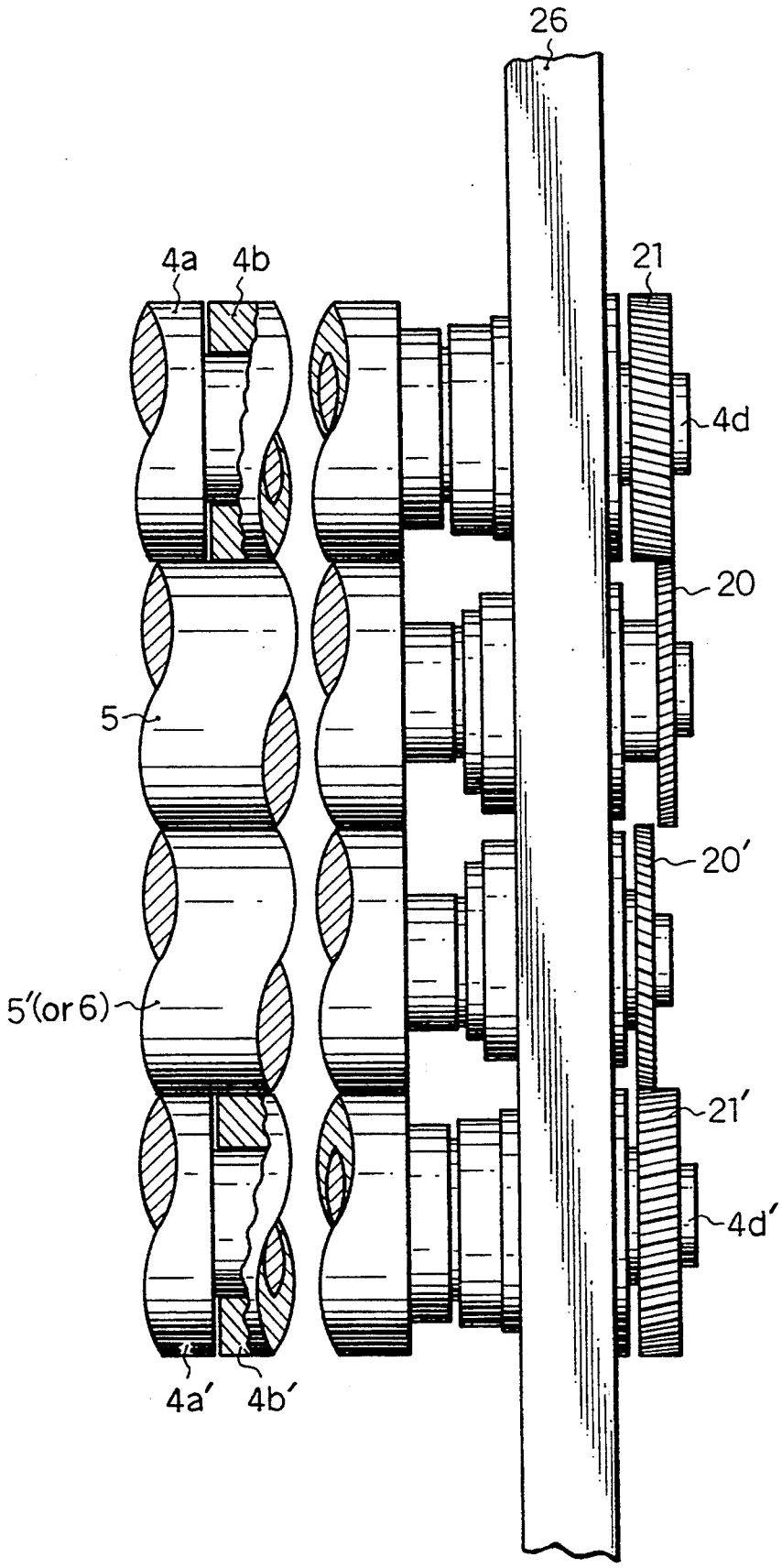
FIG. 7 is a partial plan view showing arrangement of the divided plate cylinders and the blanket cylinders (or the impression cylinder) at the operation side in the lowermost printing section in the first to third embodiments of FIGS. 1 to 3.
Figure 8:
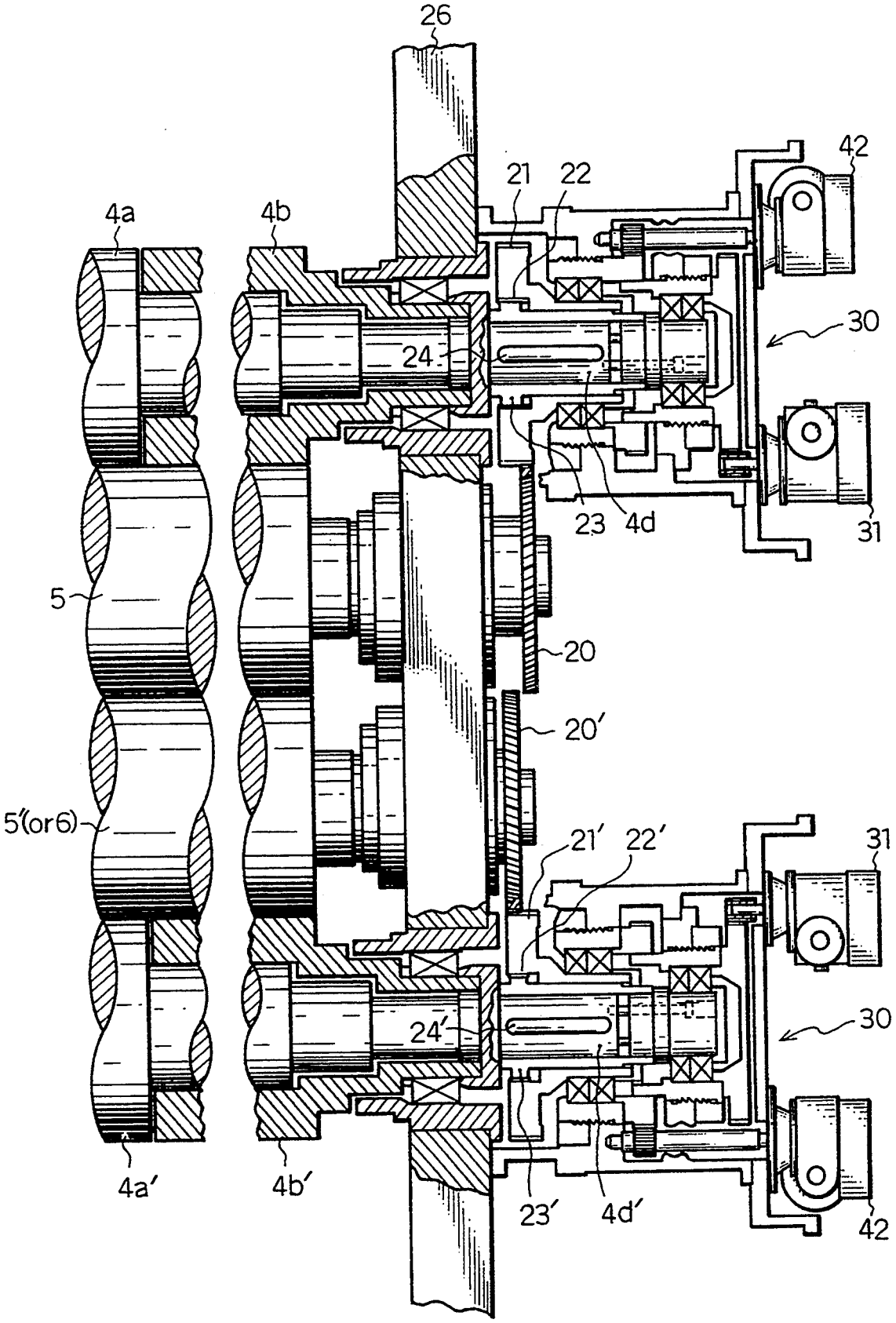
FIG. 8 is a partial sectional plan view showing arrangement of the divided plate cylinders, the blanket cylinders or the impression cylinder at the operation side in each of the printing sections other than the lowermost printing section, in the first to third embodiment of FIGS. 1 to 3, wherein, in case of the shown construction as applied for the third embodiment of FIG. 3, one of the divided plate cylinder is to be removed.
Figure 9:
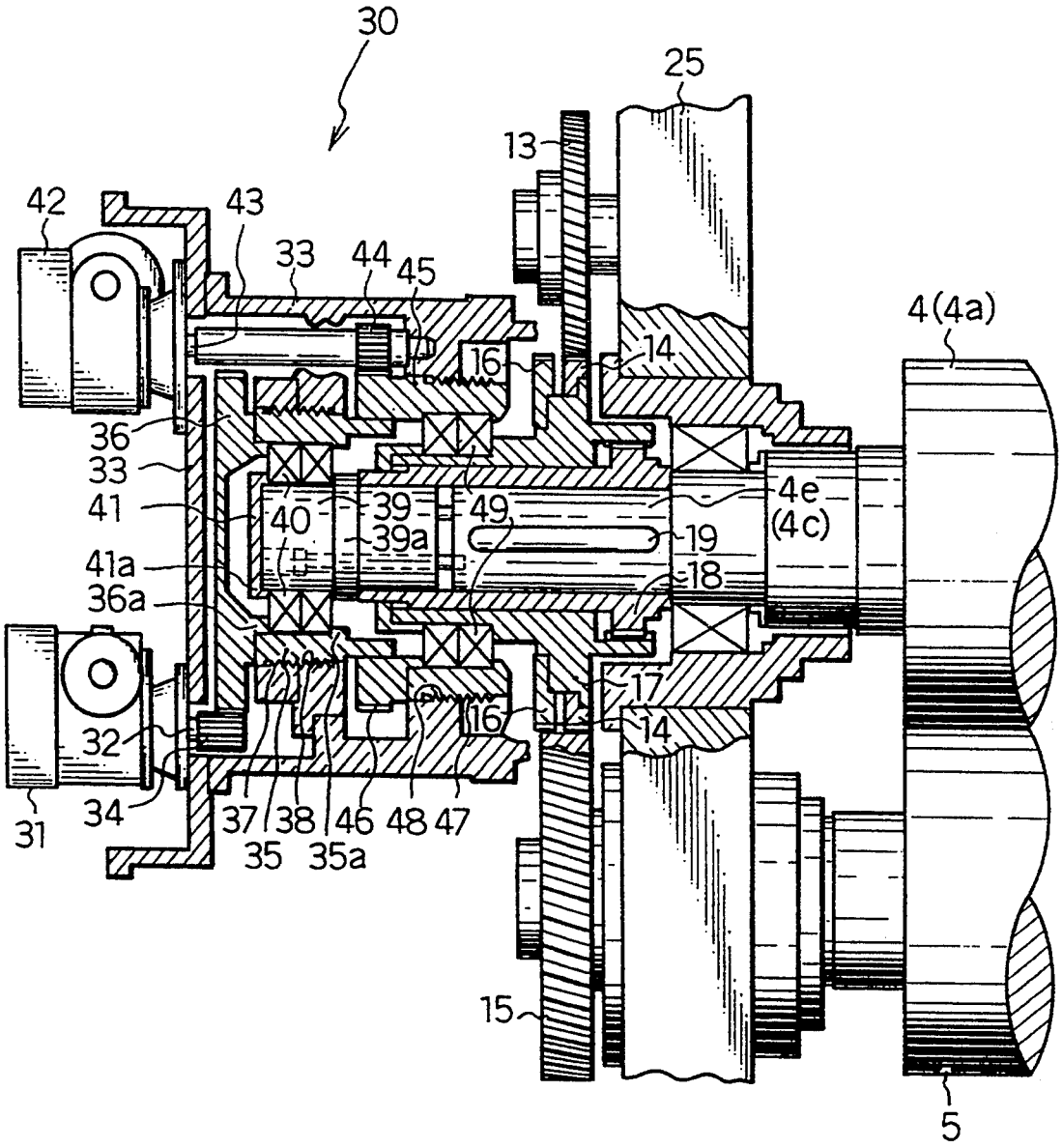
FIG. 9 is an enlarged and partially sectional view of the center portion of FIG. 5 which shows detail of a printing register adjusting means.

According to the present invention, when the plate cylinder 4 or cylinders 4, 4 in one of the printing sections 1 are set to serve as references, then, only cylinder driving mechanism is provided for these plate cylinders and not provided register position adjusting mechanism which will be discussed later. In the shown embodiment, since the plate cylinders 4 in the lowermost, first printing section 1*a* are taken as reference cylinders, only cylinder driving mechanisms are provided, as shown in FIGS. 4, 6 and 7. On the other hand, for the plate cylinders 4 in the second, third and fourth printing sections 1*b*, 1*c* and 1*d* are provided both of the cylinder driving mechanisms and the register position adjusting mechanism as shown in FIGS. 5, 8 and 9.

FIG. 4 shows plan view of the plate cylinders 4 and blanket cylinders 5 in the lowermost, first printing section 1*a* of FIGS. 1, 2 and 3. When a normal plate cylinder is employed, a driving mechanism provided on a drive side solely drives respective of the plate cylinders 4, 4' and the blanket cylinders 5, 5' in synchronism with each other. Therefore, in this case, no driving mechanism is provided at an operation side, as shown in FIG. 6.

On the other hand, as shown in FIG. 7, when a divided plate cylinders which has peripheral portion separated into a main body side plate cylinder 4*a* and a divided cylindrical plate cylinder 4*b* is employed for forming each of the plate cylinders 4 in the first printing section 1*a* of FIGS. 1, 2 and 3, an additional drive mechanism is provided at the operation side for driving the divided cylindrical plate cylinder 4*b*.

The driving mechanism for the printing section employing the divided plate cylinders will be discussed herebelow. Since the driving mechanism for the printing section with the divided plate cylinders commonly includes the drive mechanism at the driving side to the printing section which has normal, integrally formed plate cylinder, the drive mechanism for the printing section with the normal plate cylinders will be easily understood from the following discussion.

At first, at the drive side shown in FIG. 4, a driving torque transmitted from a driving power source (not shown) to a drive shaft 8 is transmitted to a bevel gear 9 which is rigidly fixed to the drive shaft 8. The bevel gear 9 is meshed with a bevel gear 10 for transmitting driving torque for driving to rotate a helical gear 12 rigidly mounted on a common shaft 11 with the bevel gear 10. The rotational torque on the helical gear 12 is transmitted to a second intermediate helical gear 14 via an intermediate helical gear 13. The second intermediate helical gear 14 is arranged in coaxial position with the plate cylinder 4 for free rotation relative to the plate cylinder 4. The second intermediate helical gear 14 is meshed with a helical gear 15 fixed to a shaft of the blanket cylinder 5 to transmit the rotational torque thereto. Since the helical gear 15 is rigidly fixed to the shaft of the blanket cylinder 5, the blanket cylinder 5 is driven to rotate with the helical gear 15.

The helical gear 15 is, in turn, meshed with a helical gear 16 which is rigidly fixed to a shaft 4*e* of the plate cylinder 4. Therefore, the plate cylinder 4 is driven to rotate together with the helical gear 16.

The helical gear 15 is further meshed with a helical gear 15' which is rigidly mounted on a shaft of the other blanket cylinder 5' (or the impression cylinder 6). Therefore, the other blanket cylinder 5' is driven to rotate with the helical gear 15' associated therewith. The helical gear 15' is, in turn, meshed with a helical gear 16' which is rigidly mounted on a shaft 4*e'* of the other plate cylinder 4' to transmit the rotational torque to drive the plate cylinder 4' together with the helical gear 16'.

It should be noted that the gear train layout has been disclosed in the U.S. Pat. No. 4,651,641, to Kawata et al., commonly assigned to the assignee of the present invention. The disclosure of the above-identified U. S. Patent is herein incorporated by reference. Also, a drive mechanism particularly adapted to the divided plate has been proposed in the co-pending Patent Application Ser. No. 07/890,551 filed on May 28, 1992, which is entitled "Blanket to Blanket Type Printing Press Employing Divided Plate Cylinder", commonly assigned to the assignee of the present invention. The disclosure of the above-identified co-pending Patent Application is also herein incorporated by reference.

Figure 10:
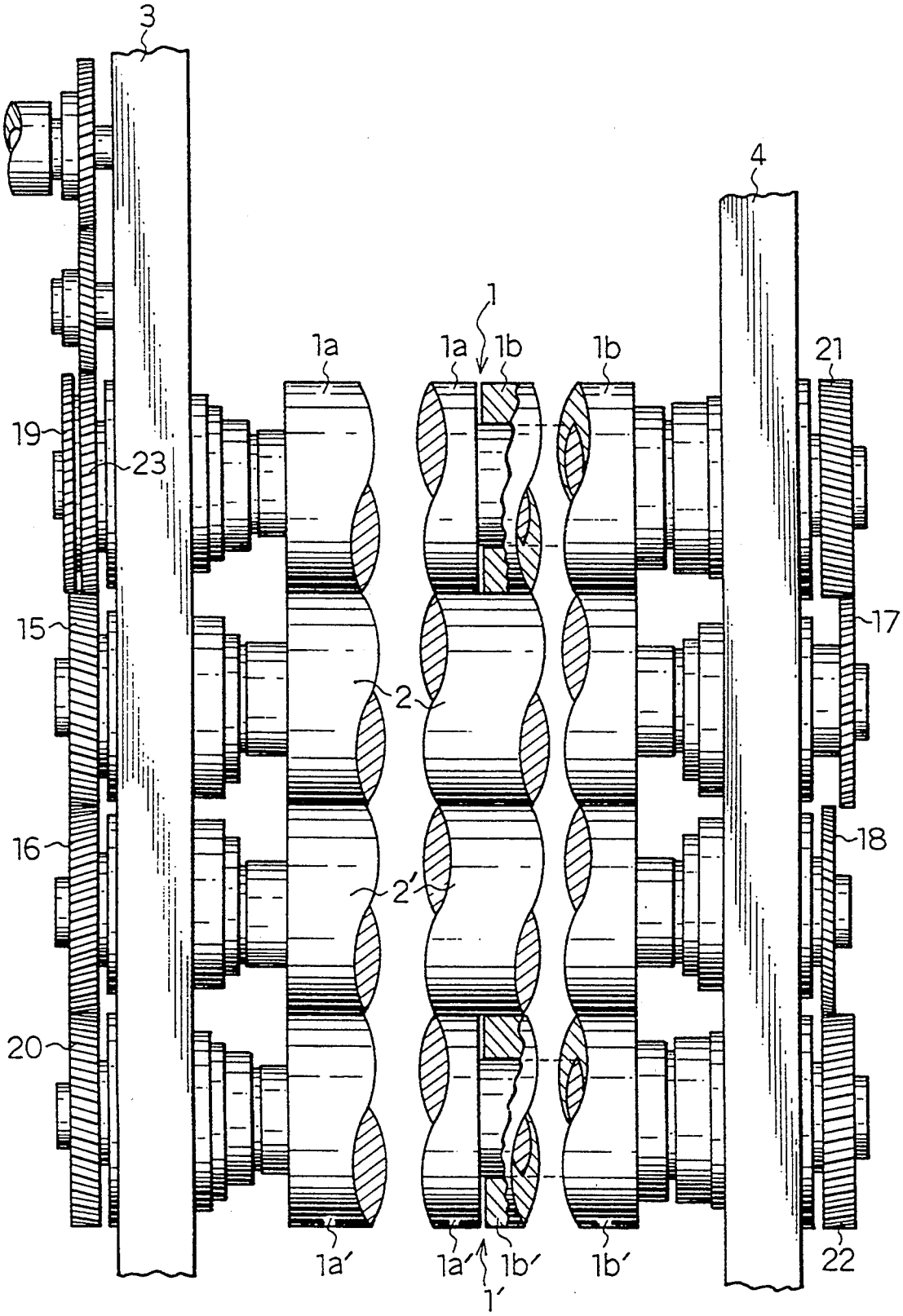
FIG. 10 is partial plan view of a BB-type printing press according to the present invention, which employs divided plate cylinders.

Referring now to the drawings, particular to FIG. 10, there is illustrated a plan view of the major part of the first embodiment of the BB-type printing press. A pair of divided plate cylinders 1 and 1' respectively including main body side plate cylinders 1*a* and 1*a'* respectively including main body side cylinders 1*a* and 1*b'*, and a pair of blanket cylinders 2 and 2' are arranged in juxtaposition between a drive side frame 3 and an operation side frame 4. The pair of blanket cylinders 2 and 2' are arranged for movement toward and aft from each other so that they may contact and release from a web paper as a printing medium, fed therebetween. Although it is not illustrated on the drawings, respective plate cylinders 1 and 1' are associated with ink arrangements and damping arrangements which may be arranged in per se well known manner.

In the shown embodiment, the finished diameters of the pair of blanket cylinders 2 and 2' are slightly smaller than the finished diameters of the plate cylinders 1 and 1'.

For the shown arrangement of the plate cylinders 1 and 1' (main body side plate cylinders 1*a* and 1*a'*and divided cylindrical plate cylinders 1*b* and 1*b'*) and the blanket cylinders 2 and 2', a drive gear train is established in the following manner. At first, for both axial ends of shafts of the blanket cylinders 2 and 2', transfer gears 15, 16, 17 and 18 are rigidly mounted. For the axial ends of shafts of the main body side plate cylinders 1*a* and 1*a'*, driven gears 19 and 20 are rigidly mounted. On the other hand, for the axial ends of the shafts of the divided cylindrical plate cylinders 1*b* and 1*b'*, driven gears 21 and 22 are rigidly mounted. The transfer gears 15 and 16 on the drive side ends of the shafts of the blanket cylinders 2 and 2' are meshed to each other for transmitting the driving torque therebetween. One of the transfer gears 15 and 16 (the transfer gear 15 in the shown case) is drivingly coupled with an intermediate gear 23 which is connected to a driving power source to be driven by the driving torque therefrom. In the shown construction, the intermediate gear 23 is rotatably mounted on the shaft of the main body side cylinder 1*a* commonly with the driven gear 19, for free rotation relative thereto. The driven gears 19 and 20 are respectively engaged with the transfer gears 15 and 16 of the blanket cylinders 2 and 2'. On the other hand, the transfer gears 17 and 18 of the blanket cylinders 2 and 2' are engaged with the driven gears 21 and 22 of the divided cylindrical plate cylinders 1*b* and 1*b'*.

With the shown power transmission layout, since the plate cylinders 1*a*, 1*a'* and 1*b*, 1*b'* having slightly greater diameters than the blanket cylinders 2 and 2' downstream of the latter with respect to the established power transmission path. Therefore, no rotation in the associated rotating condition can be caused in the blanket cylinders 2 and 2'. Therefore, relative rotational phase offset between the plate cylinder and the blanket cylinder, which phase offset is caused otherwise to degrade sharpness or clearness of the printed image or to cause doubling of printed image, can be successfully avoided to maintain high quality of the prints.

Figure 11:
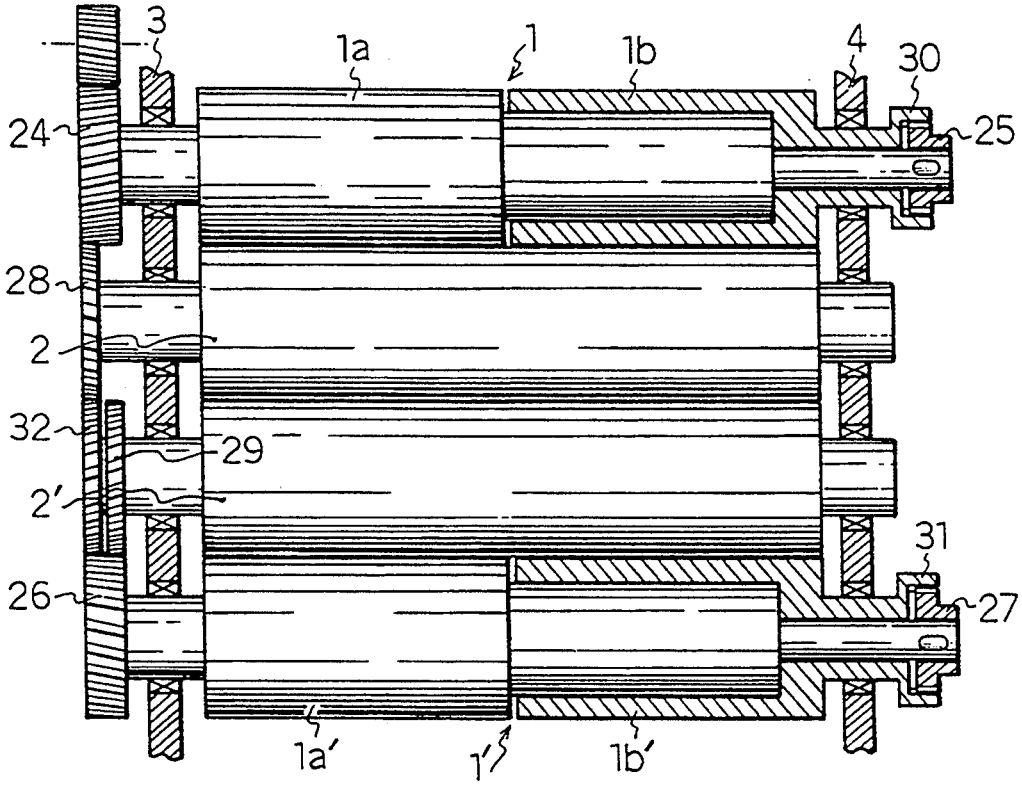
FIG. 11 is a diagrammatic plan view o another embodiment of a BB-type printing press according to the present invention.
Figure 12:
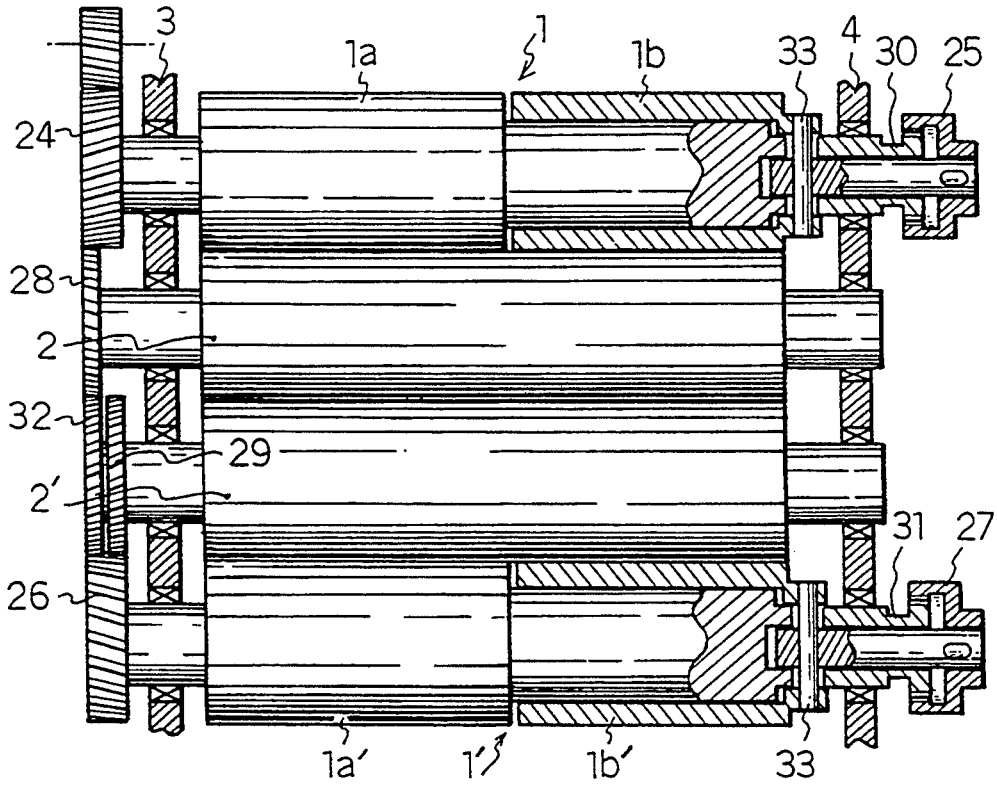
FIG. 12 is a diagrammatic plan view of a still further embodiment of a BB-type printing press according to the present invention.

FIGS. 11 and 12 respectively shows the second and third embodiments of the BB-type printing presses, according to the present invention. In these embodiments, the paris of blanket cylinders 2 and 2' are provided slightly greater finished diameter than those of the divided plate cylinders 1 and 1', contrary to the first embodiment.

In the construction shown in FIGS. 11 and 12, transfer gears 24, 25, 26 and 27 are rigidly mounted on both axial ends of shafts of the main body side plate cylinders 1*a* and 1*a'*. Driven gears 28 and 29 are respectively mounted on the drive side axial ends of the shafts of the blanket cylinders 2 and 2'. Also, the internal driven ears 30 and 31 are mounted on the shafts of the divided cylindrical plate cylinders 1*b* and 1*b'*. The transfer gear 24 of the main body side plate cylinder 1*a* is connected to a driving power source (not shown) and meshed with the driven gear 28 of the blanket cylinder 2. The driven gear 28 is, in turn, meshed with an intermediate gear 32 which is rotatably mounted on the dive side axial end of the shaft of the blanket cylinder 2' in common with the driven gear 29 but is rotatable relative to the shaft. The intermediate gear 32 is meshed with the transfer gear 26 of the main body side plate cylinder 1*a'*. The transfer gear 26 is, in turn, meshed with the driven gear 29 of the blanket cylinder 2'. On the other hand, the transfer gears 25 and 27 on the operation side axial ends of the shafts of the main body side plate cylinder 1*a* and 1*a'* are meshed with internal driven gears 30 and 31 of the divided cylindrical plate cylinders 1*b* and 1*b'*.

The foregoing drive gear train construction is common to both of the second and third embodiments. The third embodiment of the BB-type printing press is differentiated from the second embodiment, in that the internal driven gears 30 an 31 in the second embodiment are replaced with external driven gears 30' and 31', and the transfer gears 25 and 27 in the form of the external gears are replaced with internal transfer gears 25' and 27'. Also, in the construction of FIG. 12, the divided cylindrical plate cylinders 1*b* and 1*b'* and their shafts are formed separately and connected by means of connecting pins 33 for rotation together.

In the shown construction, since the blanket cylinders 2 and 2' having the larger diameters are located at the driven side (downstream in the driving torque transmission path) relative to the plate cylinders 1 and 1' (1*a*, 1*a'*and 1*b*, 1*b'*) having smaller diameter. Therefore, no rotation in the associated rotating condition can be caused on the plate cylinders.

Figure 13:
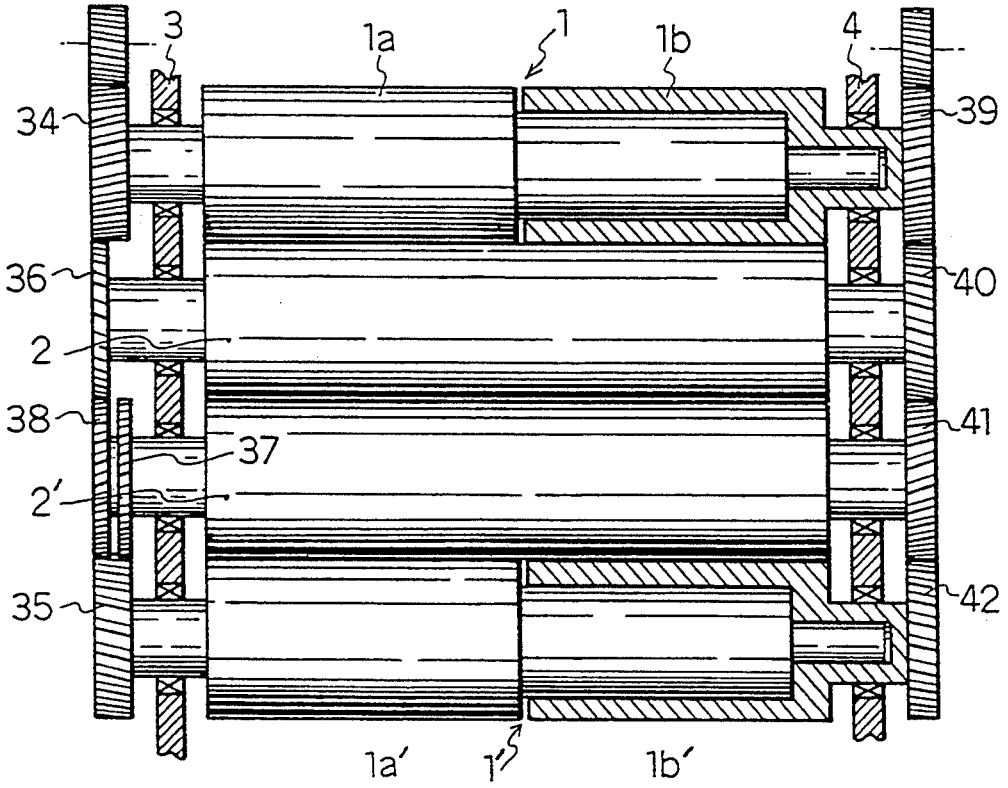
FIG. 13 is a diagrammatic plan view of a still further embodiment of a BB-type printing press according to the present invention.
Figure 14:
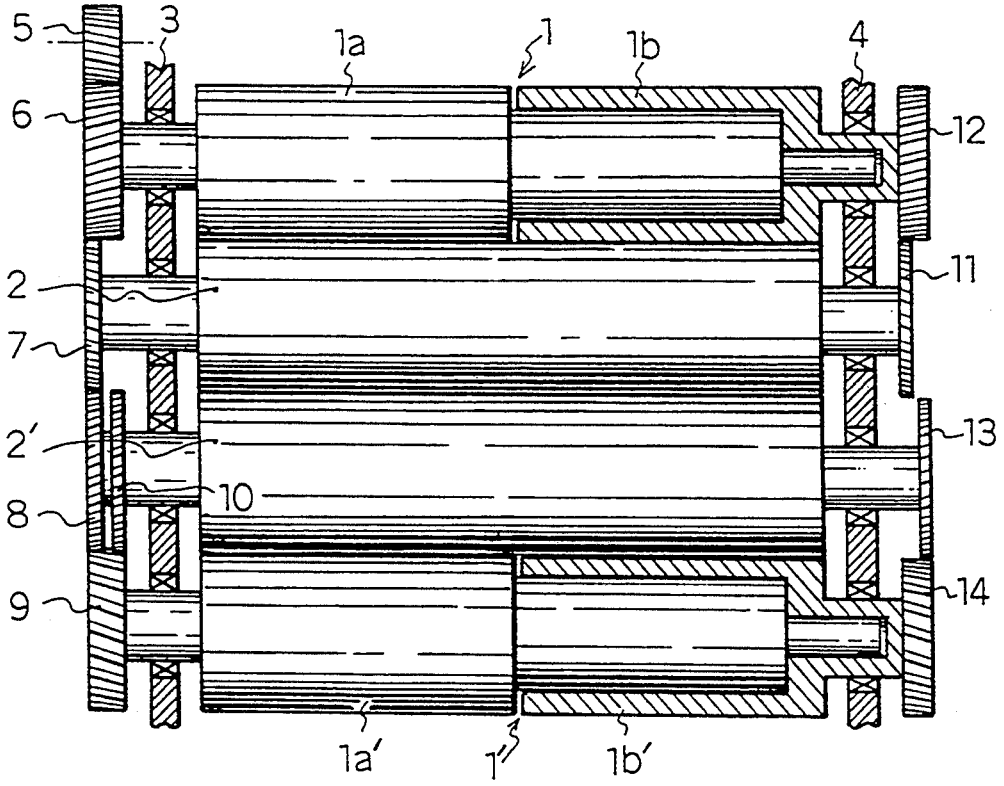
FIG. 14 (PRIOR ART)
FIG. 14 is a diagrammatic plan view of the conventional BB-type printing press.

FIG. 13 shows the fourth embodiment of the BB-type printing press, according to the present invention. In the shown embodiment, the blanket cylinders 2 and 2' are provided slightly greater finished diameters than the finished diameters of the plate cylinders 1 and 1'.

The fourth embodiment of FIG. 13 is characterized by separate drive gear trains at the drive side and the operation side. The drive gear trains at respective of the drive side and the operation side independently transmit driving torque for respective of the main body side plate cylinders 1*a* and 1*a'*, the divided cylindrical plate cylinders 1*b* and 1*b'* and the blanket cylinders 2 and 2'.

The drive gear train at the drive side includes transfer gears 34 and 35 respectively mounted on the drive side axial ends of the shafts of the main body side plate cylinders 1*a* and 1*a'*. These transfer gears 34 and 35 are respectively meshed with driven gears 36 and 37 mounted on the drive side axial ends of shafts of the blanket cylinders 2 and 2'. An intermediate gear 38 is disposed between one of the transfer gears 34 and 35 (the transfer gear 35 in the shown case) and one of the driven gears 36 and 37 (the driven gear 36 in the shown case). In the shown arrangement, the transfer gear 34 si connected to the driving power source (not shown) to receive the driving torque therefrom. The intermediate gear 38 is rotatably mounted on the drive side axial end of the shaft of the blanket cylinder 2' in common to the driven gear 37. Therefore, the driving torque of the driven gear 36 is transferred to the transfer gear 35 of the main body side plate cylinder 1*a'* via the intermediate gear 38 and then transferred to the driven gear 37 from the transfer gear 35. Therefore, similarly to the foregoing embodiments, the driving torque transmission path is established so that the driving torque is first transmitted to the main body side plate cylinders 1*a* and 1*a'* and then transmitted to the blanket cylinders 2 and 2'. As set forth with respect to the former embodiment, such drive train layout is successful in avoiding rotation in the associated rotating condition.

On the other hand, the operation side drive train includes a transfer gear 39 mounted on the operation side axial end of the shaft of the divided cylindrical plate cylinder 1*b*. The transfer gear 39 is connected to the driving power source (not shown) independently of the transfer gear 34 in the drive side. On the other hand, the transfer gear 39 is meshed with an intermediate gear 40 mounted on the operation side axial end of the blanket 2 for free rotation relative thereto. The intermediate gear 40 is, in turn, meshed with an intermediate gear 41 which is mounted on the operation side axial end of the shaft of the blanket cylinder 2' for free rotation relative thereto. The intermediate gear 41 is meshed with a driven gear 42 mounted on the operation side axial end of the shaft of the divided cylindrical plate cylinder 1*b'*. With the shown construction at the operation side, since the driving torque is active only for the divided cylindrical plate cylinders 1*b* and 1*b'* and not active on the blanket cylinders 2 and 2', the rotation in the associated rotating condition will never been caused.

As can be appreciated herefrom, according to the present invention, since the cylinders having smaller finished diameters than the other cylinders are located in the upstream position than the other cylinders, rotational driving torque is always supplied to the other and greater diameter cylinders through the smaller diameter cylinders. Therefore, rotation in the associated rotating condition will never be caused. Therefore, rotational phase shift between the associated plate cylinder and blanket cylinder can be successfully eliminated to prevent occurrence of register error. Therefore, the printed pattern can be maintained in precise alignment and thus can maintain satisfactory level sharpness and clearness of the printed pattern.

As set forth above, in case that the printing section employs the divided plate cylinders including the main body side plate cylinders 4a and 4a' and the divided cylindrical plate cylinders 4b and 4b', auxiliary drive mechanism is provided on the operation side, as shown in FIG. 7. The auxiliary drive mechanism includes helical gears 20 and 20' rigidly mounted on shafts of the blanket cylinders 5 and 5'. The helical gears 20 and 20' are thus driven in synchronism with the rotation of the blanket cylinders 5 and 5'. The helical gears 20 and 20' are respectively meshed with helical gears 21 and 21' rigidly mounted on the shafts 4d and 4d' of the divided cylindrical plate cylinders 4b and 4b'.

It should be noted that the reference numeral 25 denotes a drive side frame for supporting the abovementioned gear train provided at the drive side. On the other hand, the reference numeral 26 denotes an operation side frame for operably supporting the auxiliary drive mechanism as set forth above.

FIGS. 5, 8 and 9 are enlarged sections showing register position adjusting mechanism 30. The register position adjusting mechanism 30 includes a transverse fine adjustment assembly for fine adjustment along the rotational axes of the plate cylinders 4 and 4', and a circumferential fine adjustment assembly for fine adjustment along the circumferential direction of the plate cylinders.

The transverse fine adjustment assembly is designed for independently adjusting along the axial direction of the plate cylinders 4 and 4', or the main body side plate cylinders 4a and 4a' and the divided cylindrical plate cylinders 4b and 4b' so that the plate cylinders is shifted in the axial direction transverse to the feeding direction of the web paper 7 and whereby cause transverse shift relative to the associated blanket cylinders 5 and 5'. This causes transverse shifting of the contact points between the plate cylinders and the blanket cylinders to transversely shift the transfer position of the printing pattern from the plate cylinders and the blanket cylinders. Therefore, by adjusting the transverse shift position between the plate cylinders and the blanket cylinders, the register position of the printing pattern can be adjusted to correct register error in transverse direction.

One example of the transverse fine adjustment assembly will be discussed in detail for facilitating better understanding of the invention. As best shown in FIG. 9, the transverse fine adjustment assembly includes a drive section 31 which provide driving force for transverse fine adjustment of the register position. the drive section 31 is supported on a bracket 33 which is extended outwardly from the frame 25 or 26. An output shaft 32 of the drive section 31 supports a pinion 34 rigidly fixed thereto for rotatingly drive the latter. The pinion 34 is meshed with a large diameter gear 36 which is integral with a bearing holder 35 for transmitting the driving torque provided from the drive section 31 to the large diameter gear 36. On the outer peripheral surface of the bearing holder 35 is formed with a male thread section 37 which is engaged with a female thread member 38. The bearing holder 37 is guided by the female thread member 38 to cause axial displacement along its axis according to rotation thereof. An auxiliary shaft 39 which is provided integrally with the shaft 4e of the plate cylinder 4 is rotatably supported on the bearing holder 35 via a bearing 40. The bearing 40 has radially outer edge positioned in contact with a stopper projection 35a at one end and with the leg portion 36a of the large diameter gear 36 at the other so that the bearing 40 is restricted from axial displacement. On the other hand, the radially inner edge of the bearing 40 is in contact with the large diameter section 39a of the auxiliary shaft 39 at one end and the annular extension 41a of an axial end cap 41. With this construction, the axial displacement of the bearing holder 35 is transmitted to the plate cylinder 4 through the bearing 40, the auxiliary shaft 39 and the shaft 4e so that the plate cylinder 4 can be transversely shifted relative to the blanket cylinder 5 for shifting the register position.

It should be noted that the essentially the same construction for causing plate cylinder is applicable for the main body side cylinders 4a and 4a' and the divided cylindrical plate cylinders 4b and 4b' with the shafts 4e', 4c and 4c' or 4d and 4d'. Since all of these may employ essentially the same construction and operation as set out above, detailed discussion is neglected in order to avoid redundant discussion.

As best shown in FIG. 9, the circumferential fine adjustment assembly is also provided for each of the plate cylinders 4 and 4', the main body side plate cylinder 4a and 4a' and the divided cylindrical plate cylinder 4b and 4b'. The circumferential fine adjustment assembly is adapted to cause angular displacement of the associated plate cylinder so as to make fine adjustment along the circumferential direction of the register position of the plate cylinder relative to the associated blanket cylinder 5.

As shown in FIG. 9, according to the shown embodiment, but not limitative, the circumferential fine adjustment assembly includes a drive section 42 which is supported on the bracket 33 outwardly extended from the frame 25 or 26, in common to the drive section 31 of the transverse fine adjustment assembly. The drive section 42 includes an output shaft 43 carrying a pinion 44 rigidly fixed thereto. The pinion 44 is meshed with a large diameter gear 46 integrally formed with a bearing holder 45 so as to transmit the driving torque of the drive section 42 to the large diameter gear 46 for rotation with the bearing holder 45. On the outer peripheral surface of the bearing holder 45 is formed with a male thread section 47 which engaged with a female thread member 48. The bearing holder 45 is guided by the female thread member 48 integrally formed at the inner peripheral surface of the bracket 33 to cause axial displacement according to rotation thereof. The bearing holder 45 carries a bearing 49 which is restricted in axial displacement. The bearing 49 rotatably supports an internal gear member 17. The internal gear member 17 has internal gear teeth meshing with external gear teeth of an external gear member 18 which is integrally coupled with the shaft 4e via a key 19. The helical gear 16 meshing with the helical gear 15 in the manner set forth above with respect to the gear train, is associated with the internal gear member 17 so that the helical gear 16 may cause axial displacement according to axial motion of the internal gear member 17. The axial movement of the helical Gear 16 causes variation of rotational phase relationship between the helical gears 15 and 16 and whereby causes variation of rotational phase relationship between the plate cylinder 4 and the associated blanket cylinder 5 to allow variation of register position between the plate cylinder 4 and the blanket cylinder 5.

With respect to the construction, function and effect of the circumferential fine adjustment, reference is made to the co-pending Patent Application filed on the same date to the present invention and entitled to "MultiColor Printing Press with Feature of Rotational Phase Adjustment", commonly assigned to the assignee of the present invention. Whole disclosure of the above-identified co-pending Patent Application is herein incorporated by reference.

With the construction set forth above, the multicolor printing press, according to the present invention, in which a plurality of printing sections are arranged in vertical alignment, since the plate cylinder or cylinders in one of a plurality of the printing sections is taken as reference for adjustment of register positions of the plate cylinders in other printing sections so that adjustment of the register positions of respective of plate cylinders in the remaining printing sections can be performed to align respective color pattern with a reference color pattern, register position adjusting operation can be simplified to shorten a time required for adjustment. In addition, by making the register position adjustment easier, amount of waste paper due to register error can be reduced.

While the present invention has been discussed in detail hereabove in terms of the preferred embodiment of the invention, the present invention can be embodied in various ways, with addition and omission and/or modification of the detailed parts of the shown embodiments without departing from the principle of the invention. Therefore, the present invention should be understood to include all possible embodiments and modifications thereof which can be implemented without departing from the invention as defined in the appended claims.

What is claimed is:

1. A multicolor printing press comprising:

a plurality of printing sections arranged in vertical alignment, a plurality of said printing sections including a first printing section having a first printing assembly which includes at least one first plate cylinder positioned below a first blanket cylinder, a first ink arrangement and a first dampening arrangement which said first ink arrangement and said first dampening arrangement are positioned at lower position relative to said first plate cylinder, and at least one second printing section having a second printing assembly which includes at least one second plate cylinder positioned below a second blanket cylinder, a second ink arrangement and a second dampening arrangement which said second ink arrangement and said second dampening arrangement are positioned at lower position relative to said second plate cylinder;

a drive train for driving said plate cylinders and said blanket cylinders in synchronism with each other with maintaining desired phase relationship therebetween, said drive train establishing a path for power transmission so that the driving power is first transmitted to one of said plate cylinders and said blanket cylinders having smaller finished diameter and subsequently to the other;

means for rotatably supporting said first plate cylinder in a fixed register position for providing reference position in adjustment of register position in said second printing section;

means for rotatably supporting said second plate cylinder in a movable position for adjustment of register position thereof relative to said reference position defined by said first plate cylinder;

said drive train comprising:

respective shafts supporting said blanket cylinders;

a pair of engaged first transfer gears rigidly mounted on respective first axial ends of said shafts of said blanket cylinders;

a pair of engaged second transfer gears rigidly mounted on said respective first axial ends of said shafts of said blanket cylinders;

respective shafts supporting said first plate cylinder components;

a pair of first driven gears rigidly mounted on respective axial ends of said shafts of said first plate cylinder components, and said first driven gears engaged with the first transfer gears respectively;

respective shafts supporting said second plate cylinder components;

a pair of second driven gears rigidly mounted on respective axial ends of said shafts of said second plate cylinder components, and said second driven gears engaged with the second transfer gears respectively;

an intermediate gear connectable to a power source and engaged with one of the first transfer gears for delivery of driving torque thereto;

said driving power transmission path being established by, transferring driving torque on said one of said first transfer gears to one of said first drive gears and to the other of the transfer gears, transferring driving torque on said other of said first transfer gears to the other of said first driven gears transmitting driving torque on said both of the first transfer gears to the second transfer gears through the shafts of the blanket cylinders, and transferring the driving torque on the second transfer gears to respective of said second driven gears.

2. A multicolor printing press comprising:

a plurality of printing sections arranged in vertical alignment, a plurality of said printing sections including a first printing section and at least one sectioned printing section, each of said printing sections being constructed to form a blanket to blanket printing press incorporating a pair of plate cylinders respectively carrying printing plates, each of said plate cylinders being separated into axially aligned a first plate cylinder component and a second plate cylinder component for rotation at independently adjustable rotational phases;

a pair of blanket cylinders respectively carrying blankets and associated with said plate cylinders for receiving printing pattern of said printing plates to transfer onto both sides of a printing medium, said blanket cylinders having slightly different finished diameters from that of said plate cylinders; and a drive train for driving said plate cylinders and said blanket cylinders in synchronism with each other with maintaining desired phase relationship therebetween, said drive train establishing a path for power transmission so that the driving power is first transmitted to one of said plate cylinders and said blanket cylinders having smaller finished diameter and subsequently to the other;

means for rotatably supporting said first plate cylinder in a fixed register position for providing reference position in adjustment of register position in said second printing section;

means for rotatably supporting said second plate cylinder in a movable position for adjustment of register position thereof relative to said reference position defined by said first plate cylinder, said supporting and adjusting means being associated with each of said first and second cylinder components for independent adjustment so as to adjust position of associated one of said first and second cylinder components in the axial direction relative to the other for fine adjustment of the register positions relative to said reference position;

said drive train comprising:

respective shafts supporting said blanket cylinders;

a pair of engaged first transfer gears rigidly mounted on respective first axial ends of said shafts of said blanket cylinders;

a pair of engaged second transfer gears rigidly mounted on said respective first axial ends of said shafts of said blanket cylinders;

respective shafts supporting said first plate cylinder components;

a pair of first driven gears rigidly mounted on respective axial ends of said shafts of said first plate cylinder components, and said first driven gears engaged with the first transfer gears respectively;

respective shafts supporting said second plate cylinder components;

a pair of second driven gears rigidly mounted on respective axial ends of said shafts of said second plate cylinder components, and said second driven gears engaged with the second transfer gears respectively;

an intermediate gear connectable to a power source and engaged with one of the first transfer gears for delivery of driving torque thereto;

said driving power transmission path being established by, transferring driving torque on said one of said first transfer gears of one of said first drive gears and to the other of the transfer gears, transferring driving torque on said other of said first transfer gears to the other of said first driven gears transmitting driving torque on said both of the first transfer gears to the second transfer gears through the shafts of the blanket cylinders, and transferring the driving torque on the second transfer gears to respective of said second driven gears.

3. A multicolor printing press as set forth in claim 1 or 2, wherein said first and second plate cylinders are further provided with first and second damping arrangements respectively.

4. A multicolor printing press as set forth in claim 1 or 2, wherein said first printing section is located at most upstream position relative to feed direction of a web paper to be printed so that said first printing section performs printing for a printing pattern serving as reference printing pattern in advance of said second printing section.

5. A multicolor printing press as set forth in claim 1 or 2, wherein the outer peripheral portion of said second plate cylinder is divided in axial direction to form a first plate cylinder component and a second plate cylinder component arranged in axial alignment with respect to each other, and said adjusting means are provided independently of said first and second plate cylinder components.

6. A multicolor printing press as set forth in claim 1 or 2, wherein said adjusting means includes a first register position adjusting means for adjusting register position of said second plate cylinder relative to said reference position of said first plate cylinder in an axial direction along a rotation axis thereof;

7. A multicolor printing press as set forth in claim 6, wherein said adjusting means includes a second register position adjusting means for adjusting register position of said second plate cylinder relative to the reference position of said first plate cylinder in a circumferential direction.

8. A multicolor printing press comprising:

a plurality of printing sections arranged in vertical alignment, a plurality of said printing sections including a first printing section having a first printing assembly which includes at least one first plate cylinder positioned below a first blanket cylinder, first ink arrangement and first dampening arrangement which first and arrangement and said first dampening arrangement are positioned at lower position relative to said first plate cylinder, and at least one second printing section having a second printing assembly which includes at least one second plate cylinder positioned below a second blanket cylinder, a second ink arrangement and a second dampening arrangement which second ink arrangement and said second dampening arrangement are positioned at lower position relative to said second plate cylinder, said first and second blanket cylinders being provided with slightly smaller finished diameter than that of said plate cylinders;

a drive train for driving said plate cylinders and said blanket cylinders in synchronism with each other with maintaining desired phase relationship therebetween, said drive train establishing a path for power transmission so that the driving power is first transmitted to one of said plate cylinders and said blanket cylinders having smaller finished diameter and subsequently to the other cylinders having greater finished diameter;

means for rotatably supporting said first plate cylinder in a fixed register position for providing reference position in adjustment of register position in said second printing section; and means for rotatably supporting said second plate cylinder in a movable position for adjustment of register position thereof relative to said reference position defined by said first plate cylinder, said drive train comprises:

respective shafts supporting said blanket cylinders;

a pair of engaged first transfer gears rigidly mounted on axial ends of cylinder shafts of said blanket cylinders at said first axial end portion;

a pair of engaged second transfer gears rigidly mounted on axial ends of cylinder shafts of said blanket cylinders at said second axial end portion;

respective shafts supporting said first plate cylinder components;

a pair of first driven gears rigidly mounted on the axial ends of cylinder shafts of aid first plate cylinder components at said first axial end portion;

respective shafts supporting said second plate cylinder components;

a pair of second driven gears rigidly mounted on the axial ends of cylinder shafts of said second plate cylinder components at said second axial end portion; and an intermediate gear connectable to a power source and engaged with one of the first transfer gears for delivery of driving torque thereto, said driving power transmission path being established by connecting one of said first transfer gears to a driving power source, transferring driving torque on said one of first transfer gears to one of said fist driven gears, transmitting driving torque on said one of said first driven gears to the other of said first transfer gears via said intermediate gear, transferring driving torque on said the other of said first transfer gears to the other of said first driven gears, transmitting driving torque on said both of said first transfer gears to said second transfer gears via said cylinder shafts of said blanket cylinders, and transferring the driving torque on said second transfer gears to respective of said second driven gears.

9. A multicolor printing press comprising:

a plurality of printing sections arranged in vertical alignment, a plurality of said printing sections including a first printing section having a first printing assembly which includes at least one fist plate cylinder positioned below a fist blanket cylinder, first ink arrangement and first dampening arrangement which first and arrangement and said first dampening arrangement are positioned at lower position relative to said first plate cylinder, and at least one second printing section having a second printing assembly which includes at least one second plate cylinder positioned below a second blanket cylinder, a second ink arrangement and a second dampening arrangement which second ink arrangement and said second dampening arrangement are positioned at lower position relative to said second plate cylinder, said first and second blanket cylinders being provided with slightly smaller finished diameter than that of said plate cylinders;

a drive train for driving said plate cylinders and said blanket cylinders in synchronism with each other with maintaining desired phase relationship therebetween, said drive train establishing a path for power transmission so that the driving power is first transmitted to one of said plate cylinders and said blanket cylinders having smaller finished diameter and subsequently to the other cylinders having greater finished diameter;

means for rotatably supporting said first plate cylinder in a fixed register position for providing reference position in adjustment of register position in said second printing section; and means for rotatably supporting said second plate cylinder in a movable position for adjustment of register position thereof relative to said reference position defined by said first plate cylinder, said drive train comprises:

a pair of engaged first transfer gears rigidly mounted on first axial ends of the shafts of said first plate cylinder component;

a pair of engaged second transfer gears rigidly mounted on second axial ends of the shafts of said first plate cylinder components;

a pair of first driven gears rigidly mounted on respective of first axial ends of shafts of said blanket cylinders, and engaged with the first transfer gears respectively;

a pair of second driven gears rigidly mounted on the second axial ends of the shafts of said second plate cylinder components, and engaged with the second transfer gears respectively;

an intermediate gear engaged with one of said first transfer gears and also engaged with one of the first driven gears; and said driving power transmission path being established by supplying driving torque of a driving power source to one of said first transfer gears, transferring the driving toque on said one of said first transfer gears to one of said first driven gears and to one of said second transfer gears through said shaft of one of said first plate cylinder components, transferring the driving torque on said one of the direst driven gears to the other of said first transfer gears through said intermediate gear, transferring the driving torque on the other of said first transfer gears to the other of said first driven gears and to the other of said second transfer gears through said shaft of the other first plate cylinder components, and transferring driving torque on respective of said second transfer gears to respective of said second driven gears.

* * * * *

UNITED STATES PATENT AND TRADEMARK OFFICE

CERTIFICATE OF CORRECTION

PATENT NO. : 5,331,890

DATED : July 26, 1994

INVENTOR(S) : Masahiko Miyoshi, Kiyohisa Asanuma, Kazuhiro Soutome

It is certified that error appears in the above-indentified patent and that said Letters Patent is hereby corrected as shown below:

Column 3, Line 37 " view o another" should read — view of another —

Column 7, Line 16 "paris" should read —pairs —

Column 7, Line 25 "ears" should read — gears —

Column 7, Line 47 "30 an 31" should read — 30 and 31 —

Column 8, Line 16 "34 si connected" should read — 34 is connected —

Column 14, Line 58 "shafts of aid" should read — shafts of said —

Column 15, Line 5 "said fist driven gears" should read — said first driven gears —

Column 15, Line 21 " fist plate" should read — first plate —

Column 15, Line 22 " fist blanket cylinder" should read — first blanket cylinder —

Column 16, Line 37 "direst" should read — first —

Signed and Sealed this

Twenty-second Day of November, 1994

*Attest:*

Bruce Lehman

BRUCE LEHMAN

*Attesting Officer*

*Commissioner of Patents and Trademarks*